United States Patent [19]

Fischer et al.

[11] 4,249,049

[45] Feb. 3, 1981

[54] HIGH VOLTAGE PLAIN BREAK CIRCUIT INTERRUPTER

[75] Inventors: William H. Fischer, Pittsburgh; Charles F. Cromer, Trafford; Robert L. Hess, N. Versailles; Lee E. Berkebile, Pittsburgh, all of Pa.

[73] Assignee: Electric Power Research Institute, Inc., Palo Alto, Calif.

[21] Appl. No.: 861,859

[22] Filed: Dec. 19, 1977

[51] Int. Cl.[3] ..... H01H 33/24; H01H 9/48

[52] U.S. Cl. ..... 200/144 R; 200/144 AP; 200/148 R

[58] Field of Search ..... 200/148 R, 144 R, 144 AP

[56] References Cited

FOREIGN PATENT DOCUMENTS

| | | | |
|---|---|---|---|
| 221596 | 10/1957 | Australia | 200/148 R |
| 145743 | 5/1936 | Austria | 200/148 R |
| 655480 | 1/1938 | Fed. Rep. of Germany | 200/148 R |
| 267793 | 7/1950 | Switzerland | 200/148 R |
| 404766 | 7/1966 | Switzerland | 200/148 R |

*Primary Examiner*—Robert S. Macon

*Attorney, Agent, or Firm*—Flehr, Hohbach, Test, Albritton & Herbert

[57] ABSTRACT

An improved circuit interrupter for high voltage and low current provides reactor and capacitor switching functions with fewer serial interrupters. Improved electrical field configuration is provided by moving and stationary contact shields, surrounding the main contacts, which aid the plain break operation of the device by elimination of critical points of dielectric stress. The plain break feature provides less mechanical complexity and consequent higher reliability.

7 Claims, 4 Drawing Figures

HIGH VOLTAGE PLAIN BREAK CIRCUIT INTERRUPTER

BACKGROUND OF THE INVENTION

This invention relates to a high voltage circuit interrupter, and more particularly to a device for switching shunt reactors and shunt capacitor banks for voltage control and transmission line compensation.

Devices presently available to switch reactors and capacitor banks into and out of circuit with power transmission lines include disconnect switches, load break switches and circuit breakers. Interruption provided by a disconnect switch is not clean, and the switches are vulnerable to the weather which may effect their performance. Circuit breakers are costly devices. The low current load break switches require many interrupters in series, for example six interrupters at 550 kilovolts, and must be used with conventional disconnect switches. Moreover, the slowness of the disconnect switches present problems with synchronism between phases in a multi-phase transmission circuit. Transient voltage control resistors associated with disconnect switches are generally located external to the interrupter and are also vulnerable to the weather. Such resistors are generally inserted by the disconnect switch blade which travels at high velocity and must be precisely guided mechanically.

Two-pressure interrupters for switching reactors and shunt capacitors in a power transmission circuit require a high pressure gas system with a compressor, storage vessels having auxiliary heaters, and a complex valving system to provide the gas blast during circuit interruption. "Puffer" interrupters provide the high pressure gas blast through a piston and a cylinder where a fixed piston and a moving cylinder attached to the moving interrupter contact compresses the gas which is then directed to the area within the interrupter where arcing occurs. "Puffer" interrupters require high mechanical forces to compress the gas, thereby increasing mechanical loads, and requiring comparatively complex structure.

There is a need for a simplified high voltage circuit interrupter which reduces the number of required serial interrupters to break a high voltage circuit, and which substantially reduces the required mechanical complexity now seen in two-pressure and "puffer" interrupters.

OBJECTS AND SUMMARY OF THE INVENTION

In general, it is an object of the present invention to provide an improved plain break circuit interrupter for a high voltage circuit.

Another object of the present invention is to provide a plain break circuit interrupter for a high voltage circuit having reduced mechanical complexity and increased reliability.

In accordance with the above objects there is provided a high voltage circuit interrupter with first and second contact means movable toward each other for making electrical contact. The first contact means includes a first central main contact portion and a first surrounding concentric substantially cylindrical portion at the same potential as the main contact portion. Second contact means include a second central main contact portion for slidably mating with the first central main contact portion. A second surrounding concentric substantially cylindrical portion at the same potential as the second main contact portion and with a larger diameter than the first cylindrical portion receives and surrounds a part of the first cylindrical portion when the main contact portions are slidably mated.

DETAILED DESCRIPTION OF THE PREFERRED EMBODIMENTS

Figure 1:
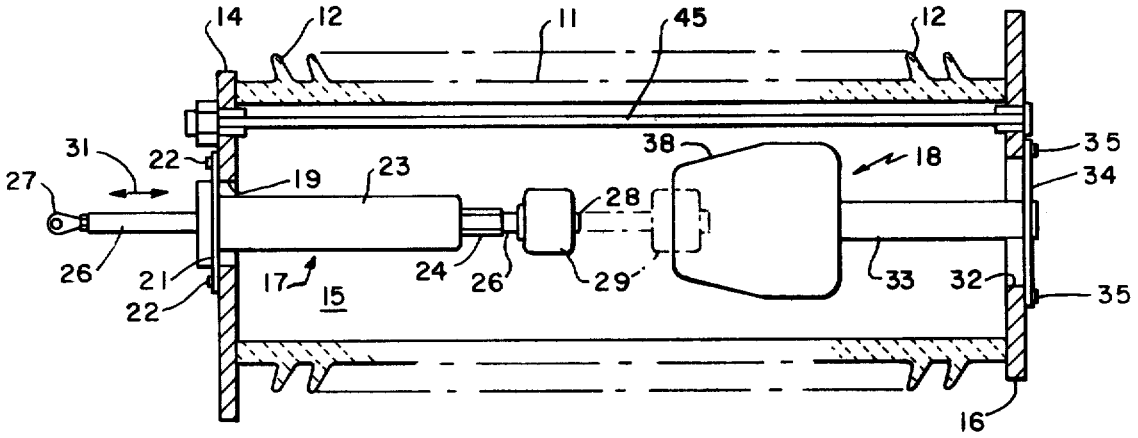
FIG. 1 is a side sectional view of a high voltage interrupter in accordance with the invention.

Referring to FIG. 1, a cylindrical insulator housing 11, which may be of ceramic or porcelain, includes fins 12 to provide additional electrical surface creep. A removable contact mounting plate 14 is mounted across one end of insulator housing 11, and a stationary contact end plate 16 is mounted across the opposite end of insulator housing 11 and tied together by rods 45 to form a chamber 15. Both end plates include means for making electrical contact with the line being switched.

A moving contact subassembly 17 is mounted on end plate 14 and a stationary contact subassembly 18 is mounted on end plate 16. Specifically moving contact subassembly 17 includes a flange member 21 near one end mounted across a hole 19 and fastened to plate 14 by bolts 22. Moving contact subassembly 17 has a neck portion 23 which supports a current collector finger assembly 24 therein. A moving contact actuating arm 26 passes through flange 21 and finger assembly 24. Arm 26 includes an eye 27 which is engaged by an external member, not shown, for opening and closing the interrupter. The interior end of moving contact arm 26 is terminated in a main moving contact 28. A moving shield 29 is also mounted on moving contact arm 26 surrounding and concentric with moving contact 28. Contact 28 and shield 29 substantially terminate in the same plane (perpendicular to motion direction 31). The termination of shield 29 is a rolled edge **29*a* (see FIG. 2). The solid lines show moving contact 28** in an open position and the dashed lines in a closed position.

Figure 2:
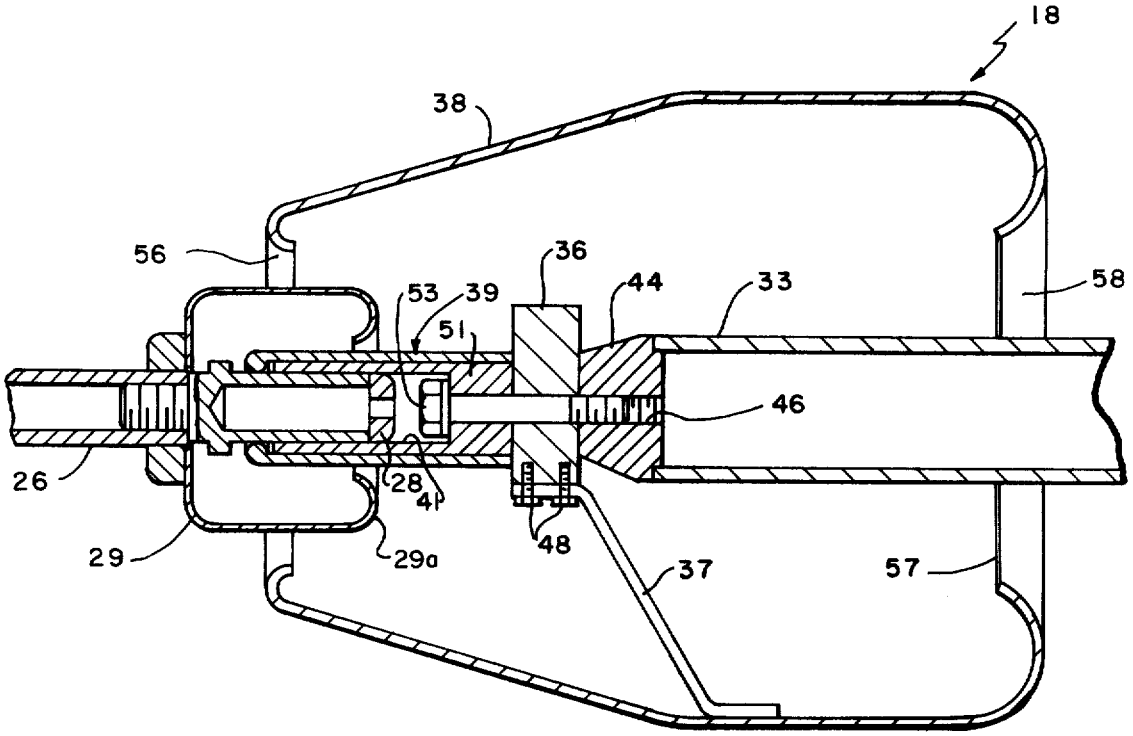
FIG. 2 is a detailed view of the contacts of the embodiment of FIG. 1 in a closed position.

Stationary contact subassembly 18 is carried on a post 33 extending through hole 32 and mounted to end plate 16 by means of a flange 34. Flange 34 is fixed in position by bolts 35. Referring also to FIG. 2 stationary post 33 extends inwardly in chamber 15 and has a shield support block 36 and plug 44 mounted on its end. One or more arms 37 have one end fastened to shield support block 36 by screws 48 and another end fastened to a stationary substantially cylindrical shield 38 having a truncated conical end portion which terminates in rolled edge 56. Within and surrounded by stationary shield 38 is a main contact including stationary finger contacts 39, having a female bore 41 for slidably mating with male type moving contact 28.

Referring now to FIG. 2 stationary main contact 39 extends from a plug 51 which is mounted to post 33 by a bolt 53 which passes through block 36 to engage the threaded hole 46 in plug 44. Stationary shield 38 has its rolled front edge 56 in the same plane as the end of main contact 39. Stationary shield 38 also has a rolled edge 57 surrounding a rear aperture 58 therein through which stationary post 33 passes.

In operation in the open position shown in FIG. 1, both the respective main contacts 28 and 39 are the same potential as their shields 29 and 38. Because of the contour and/or configuration of the shields, critical points of dielectric stress (i.e. equipotential lines bunched together) are prevented both during opening and closing. Thus when closing, prestrike is prevented and after interruption restrike and re-ignition are prevented. This therefore provides the plain break capability of the present invention.

Figure 3:
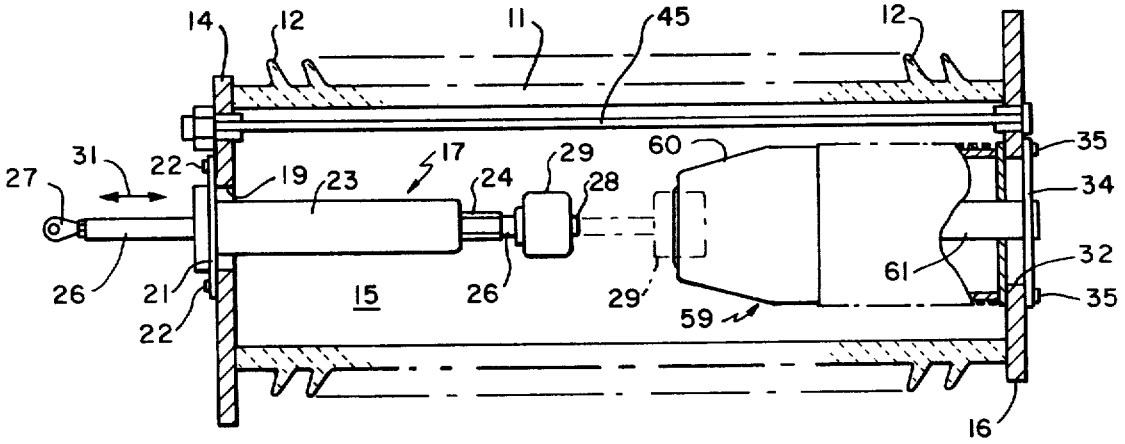
FIG. 3 is a side sectional view of another embodiment of the high voltage interrupter assembly.

Turning to FIG. 3, another embodiment of the invention is shown wherein structural members alike to those shown in FIGS. 1 and 2 carry like reference numbers. FIG. 3 shows a stationary contact subassembly 59 having a stationary post 61 therethrough which has flange 34 for mounting on end plate 16. Stationary contact subassembly 59 includes a stationary shield 60. As in FIG. 1 above, movable contact 28 and movable shield 29 are shown in the open or interrupt position in solid line and in a closed position in dashed line.

Figure 4:
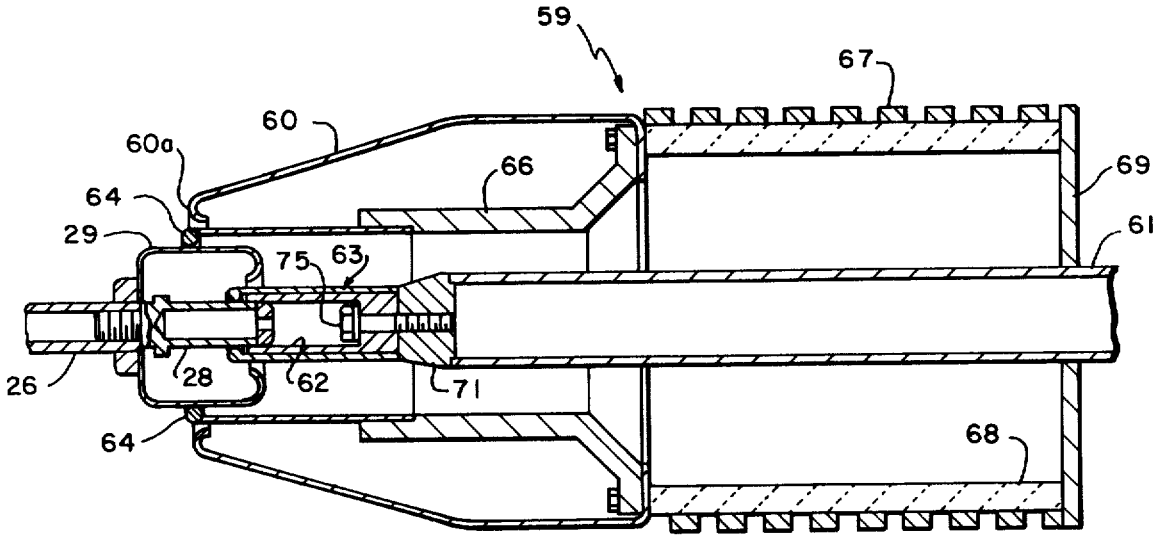
FIG. 4 is a detailed view of the contacts of the embodiment of FIG. 3 in a closed position.

FIG. 4 is a detail of stationary subassembly 59 of FIG. 3 showing moving contact 28 accepted within a bore 62 on a stationary main contact 63. Moving shield 29 is in contact at its periphery with resistor contacts 64, which are coupled electrically through a conductive member 66 to a resistor 67. Resistor 67 is a ribbon resistor wound on a ceramic cylinder 68. A conductive end plate 69 is in contact with one end of resistor 67 coupling the resistor to stationary post 61.

Post 61 has an end plug 71 which by means of bolt 75 supports main contact 63.

Fixed shield 60 terminates in a rolled edge **60*a* in the same plane as resistor contacts 64. However, as compared to the embodiment of FIG. 2, such plane is offset from the end of main contact 63**.

In operation resistor 67 is an electrical path parallel to the path through moving contact 28 and stationary contact 63. Such parallel conductive path is provided from stationary post 61, through end plate 69 and resistor 67, through conductive member 66, resistor contacts 64, and movable shield 29 to moving contact arm 26. The path through the main contacts extends from stationary post 61 through end plug 71, stationary contact 63, movable contact 28 and moving contact arm 26. As shown also in FIG. 4, when moving contact arm 26 begins to move toward the open position, movable contact 28 parts from stationary contact 63 prior to movable shield 29 parting from resistor contacts 64. Consequently, in interrupting a high voltage circuit, primary contacts 28 and 63 are separated first and current still flows through resitor 67 and resistor contacts 64. When resistor contacts 64 part from movable shield 29, an arc is drawn and the current through resistor 67 is subsequently interrupted. On closing, movable shield 29 first contacts resistor contacts 64 inserting resistor 67 in the circuit. After further travel movable contact 28 is accepted by stationary contact 63 shunting resistor 67 and effectively removing it from the current path.

The embodiment of FIGS. 3 and 4 thus provides a parallel path including resistor contacts 64 and resistor 67 for reducing the magnitude and duration of transient voltages during contact closing and contact interruption. At the same time it provides the same advantages as FIGS. 1 and 2.

Experimental tests have shown that this invention containing low pressure SF6 arc suppressant gas within chamber 15 is capable of interrupting 400 amperes capacitor current and 200 amperes reactor current at 550 kilovolts with two serial interrupters per phase. The upper limits of the interrupter's capability have not yet been determined.

In summary, a high voltage circuit interrupter has been disclosed which utilizes a plain break, and affords reduced dielectric stress in the open gap due to the presence of the shields. The interrupter is especially useful for switching capacitor banks and reactors for voltage control and transmission line compensation.

What is claimed is:

1. A high voltage plain break interrupter comprising: first and second contact means movable toward each other for making electrical contact, said first contact means including a first central main contact portion and a first surrounding concentric substantially cylindrical shield at the same potential as said main contact portion, said second contact means including a second central main contact portion for slidably mating with said first central main contact portion and a second surrounding concentric substantially cylindrical shield at the same potential as said second main contact portion and with a larger diameter than said first cylindrical portion for receiving and surrounding a part of said first cylindrical shield when said main contact portions are slidably mated, said first and second surrounding shields each terminating in a rolled edge which face each other when the interrupter is open whereby critical points of dielectric stress are prevented both during opening and closing.

2. An interrupter as in claim 1 where said second contact means is of the female type for receiving both said first main contact portion and said first concentric shield.

3. An interrupter as in claim 1 where said first and second concentric shields terminate at substantially the same respective planes, perpendicular to the axis of movement of said contact means toward each other, as said first and second main contact portions.

4. An interrupter as in claim 1 where said second concentric shield includes resistor means for electrically connecting it to said second main contact portion said second concentric shield also including contact means for slidably mating with said first concentric shield for making electrical contact.

5. An interrupter as in claim 4 where said second concentric shield terminates in a plane, perpendicular to the axis of movement of said contact means toward each other, offset from and closer to said first contact means than the corresponding termination plane of said second main contact portion.

6. An interrupter as in claim 4 where said first main contact portion and said first concentric shield terminate in a common plane whereby said contact means of said second concentric shield electrically contacts said first concentric shield before said first and second main contact portions mate.

7. An interrupter as in claim 1 where said second concentric shield includes a truncated conical portion.

* * * * *